United States Patent [19]

Hannebaum

[11] 3,986,488

[45] Oct. 19, 1976

[54] FIREPLACE

[75] Inventor: Harold W. Hannebaum, Bellevue, Idaho

[73] Assignee: The Raymond Lee Organization, Inc., a part interest

[22] Filed: May 27, 1975

[21] Appl. No.: 580,808

[52] U.S. Cl. ..... 126/120; 126/60; 126/65; 126/137; 126/200

[51] Int. Cl.[2] ..... F24B 1/26

[58] Field of Search ..... 126/137, 126, 120, 200, 126/146, 151, 60, 80, 83, 62, 65

[56] References Cited

UNITED STATES PATENTS

| | | | |
|---|---|---|---|
| 165,393 | 7/1875 | White | 126/60 |
| 1,382,880 | 6/1921 | Armstrong | 126/60 |
| 2,220,604 | 11/1940 | Jepertinger | 126/151 |
| 3,499,432 | 3/1970 | Hannebaum | 126/120 |
| 3,757,766 | 9/1973 | Stevenson | 126/200 |
| 3,868,942 | 3/1975 | Lewis | 126/25 R |

FOREIGN PATENTS OR APPLICATIONS

| | | | |
|---|---|---|---|
| 1,246,864 | 10/1959 | France | 126/80 |
| 513,859 | 10/1919 | France | 126/65 |

*Primary Examiner*—John J. Camby
*Assistant Examiner*—Larry I. Schwartz

[57] ABSTRACT

A generally cylindrical casing is hollow, and is supported by a base so that the axis of the casing axis is horizontal. A vertical partition divides the casing into a fire chamber and a smaller exhaust chamber. The smaller chamber is vented to the outside atmosphere by a chimney. The partition does not completely isolate the chambers, but enables them to be interconnected through a small gap at its bottom. Extending rearwardly along the curved portion of the casing are two oppositely disposed parallel elongated air intake slits at the level of the bottom of the partition. One of these slits is defined by the gap between a hinged lid allowing access to the fire chamber and the casing. The major portion of the section of the casing that surround the fire chamber is of glass, and the bottom of the fire chamber is lined with fire clay.

6 Claims, 4 Drawing Figures

FIG.1
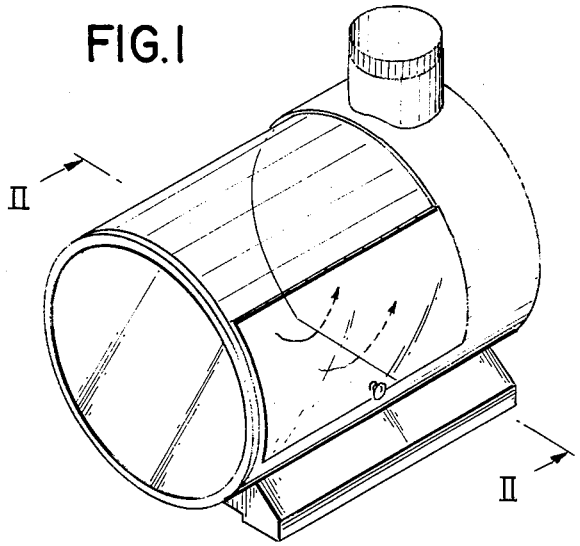
FIG.2
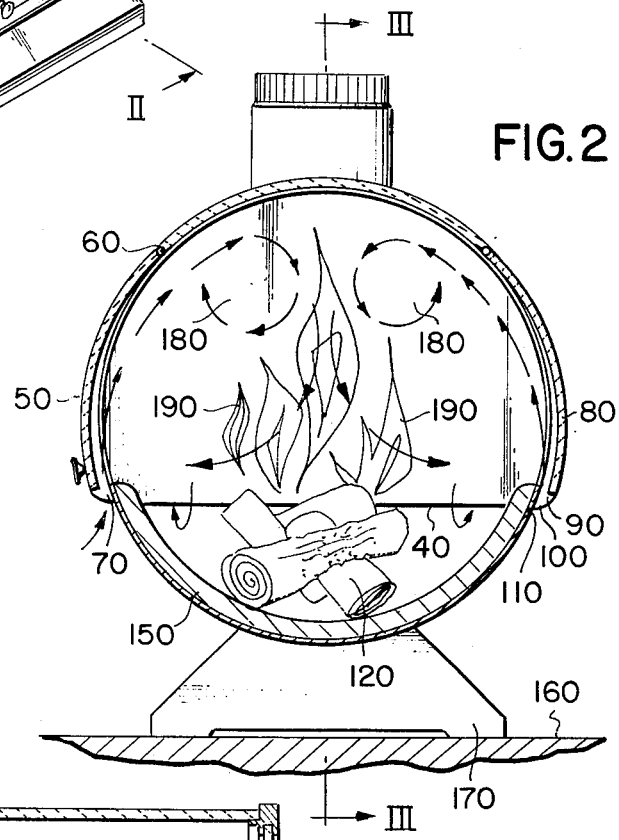
FIG.4
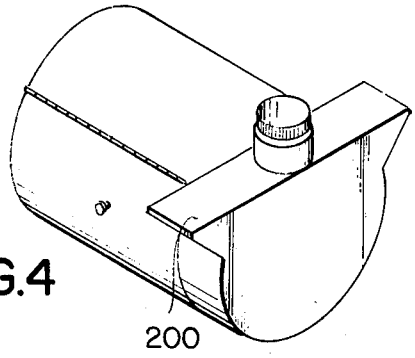
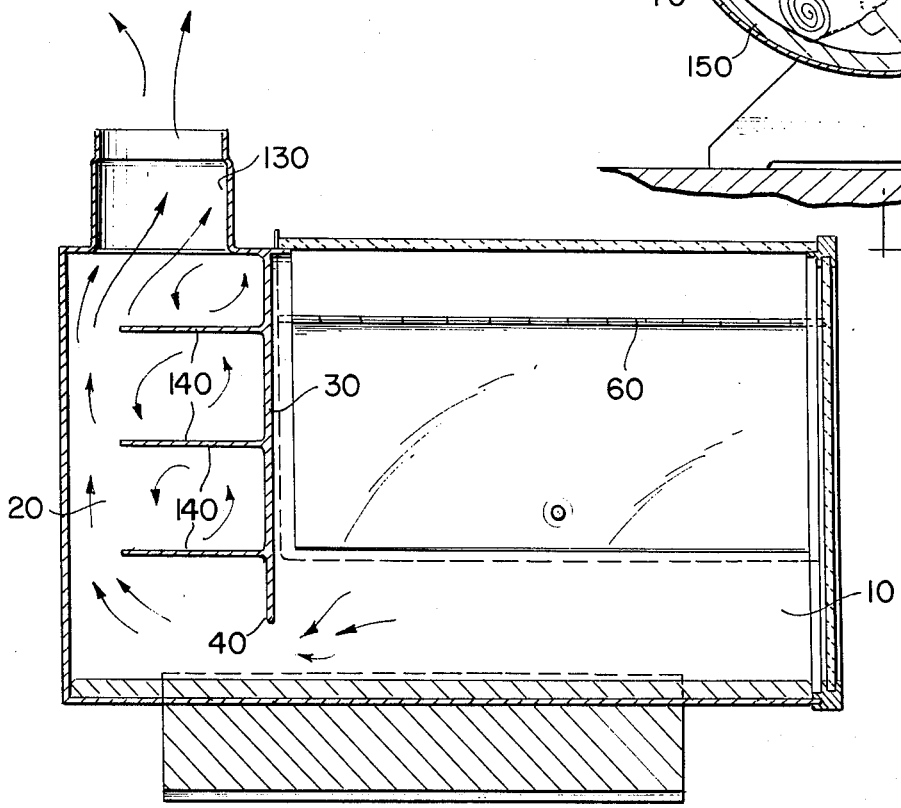
FIG.3

FIREPLACE

SUMMARY OF THE INVENTION

This invention is directed toward a small fireplace that is designed to be both an efficient source of heat and an item of decoration. It uses a fire that is fed by rotating vortexes of fresh air, and that thus swirls around in the fire chamber of the fireplace, producing a desirable visual appearance.

The invention uses a generally cylindrical hollow casing that has both ends closed and is divided into a fire chamber and a smaller exhaust chamber located behind it. A partition separates the chambers, but leaves a space between its lowest edge and the casing to allow smoke to pass from the fire chamber into the exhaust chamber. The exhaust chamber is vented to the outside atmosphere by a chimney to void the combusted gases.

A pair of elongated parallel slits, which are coplanar with a horizontal plane passing through the bottom of the partition, allow air to enter the fire chamber. The shape of the chamber causes the air to be swirled around violently, raising combustion efficiency. In use, this fireplace is so efficient that even when the casing surrounding the fire chamber is constructed of glass, the glass very seldom needs cleaning. The fire produced in the fire chamber is always in violent motion, resulting in an attractive decorative effect.

BRIEF DESCRIPTION OF THE DRAWINGS

FIG. 1 is a perspective drawing of the invention.
FIG. 2 is a view along line 2—2 of FIG. 1.
FIG. 3 is a view along line 3—3 of FIG. 2.
FIG. 4 shows a second embodiment of the invention.

DETAILED DESCRIPTION OF PREFERRED EMBODIMENTS

Referring now to FIGS. 1–4, a casing with a horizontal axis is generally cylindrical, hollow, and has closed ends. It is divided into a fire chamber 10 and an exhaust chamber 20 by a vertical partition 30. The casing surrounding the smaller chamber 20 is made of metal, while most of the casing surrounding the chamber 10 is made of glass. The partition has a horizontal bottom edge 40, and, in the space between that bottom edge and the casing, the exhaust gases created in the fire chamber can pass into the exhaust chamber.

A curved glass lid 50 is hinged to the casing by hinge 60 and forms part of the curved portion of the casing. The lid protrudes slightly outwardly, to form a thin horizontal slit 70 between the bottom of the lid and the casing. This slit extends horizontally rearwardly parallel to the axis of the cylinder and terminates at the point where the partition is located. This slit 70 is located in the horizontal plane that includes the bottom endge of the partition. This slit allows air to enter the fire chamber even when the lid is in its most fully closed position. Similarly, a panel 80 identical to the lid but not hingedly attached to the casing juts out in the same fashion, defining slit 90 which is parallel to and identical to slit 70. However, louver 100 is hingedly attached to the casing by hinge 110 and can be moved up and down to block off or open slit 90 as needed. Both these slits have the function of allowing air to pass into the fire chamber to enable fuel 120 to be combusted therein.

The exhaust chamber is vented to the outside atmosphere through chimney 130. Below the chimney in the exhaust chamber are three like, parallel baffles 140 that are supported by the partition.

The bottom of the fire chamber is lined with fire clay 150, and the whole device is supported on horizontal surface 160 by base 170. When the fuel is introduced into the fire chamber, lit, and allowed to burn with the lid closed, air is drawn into the fire chamber at relatively high velocity, because of the narrowness of the slits. The fresh air taken into the fire chamber generally follows the arrows in FIG. 2, forming swirling vortexes 180 and thus generating violent, swirling flames 190. The exhaust gases then pass under partition 30 into the exhaust chamber, where they can exit the device through the chimney. The baffles prevent ashes from flying out the chimney, but the amount of ashes to be dealt with is very low, on coal-wood or any other fuel, because of the extreme efficiency of the combustion process.

The embodiment of the invention shown in FIG. 4 incorporates a rectangular horizontal cooking surface 200 that is bisected by the chimney. This surface is formed by the top of the exhaust chamber, and can be used to cook foods which require high cooking heats.

In use, the louver is adjusted so as to get the most efficient combustion. It may be opened or closed as needed. It has been found that the combustion in the fire chamber is so efficient when the louver is properly adjusted that the inside surfaces of the glass portion of the casing seldom, if even, need cleaning.

Although the invention has been described with particular reference to the drawings, the protection sought is to be limited only by the terms of the claims which follow.

What is claimed is:

1. A fireplace, comprising:

a hollow, generally cylindrical casing having a horizontal axis, said casing having closed ends and a hinged lid and further having two parallel elongated air intake slits parallel to the axis, said slits extending rearwardly along the curved surface of the casing to an endpoint intermediate the ends of the casing, the slits allowing air to be taken into the interior of the casing, there being a gap disposed between a lower end of the lid and the rest of the casing, said gap defining one of said slits;

a vertical partition placed at the endpoint and dividing the casing into a fire chamber and an exhaust chamber, the partition restricting all communication between the chambers to an opening between the casing and the bottom of the partition;

a base supporting the casing upon a horizontal surface; and a chimney venting the exhaust chamber to the outside atmosphere.

2. The device of claim 1 wherein the two slits define a horizontal plane containing the bottom edge of the partition.

3. The device of claim 2 wherein the exhaust chamber supports at least one horizontal baffle located below the chimney.

4. The device of claim 3 wherein the major portion of the section of the casing that surrounds the fire chamber is constructed of glass.

5. The device of claim 4 wherein the bottom of the fire chamber is coated with fire clay.

6. The device of claim 5 wherein the casing on the top of the exhaust chamber is elongated to form a horizontal cooking surface bisected by the chimney.

* * * * *